US011767084B1

(12) United States Patent
Stuart, Sr.

(10) Patent No.: US 11,767,084 B1
(45) Date of Patent: Sep. 26, 2023

(54) MULTI-SECTIONED HARD TOP BOAT COVER

(71) Applicant: Mark Paul Stuart, Sr., Pace, FL (US)

(72) Inventor: Mark Paul Stuart, Sr., Pace, FL (US)

( * ) Notice: Subject to any disclaimer, the term of this patent is extended or adjusted under 35 U.S.C. 154(b) by 217 days.

(21) Appl. No.: 17/444,002

(22) Filed: Jul. 29, 2021

(51) Int. Cl.
*B63B 17/02* (2006.01)
*B63B 17/00* (2006.01)

(52) U.S. Cl.
CPC ..... *B63B 17/02* (2013.01); *B63B 2017/0045* (2013.01); *B63B 2017/026* (2013.01)

(58) Field of Classification Search
CPC ..... B63B 17/02; B63B 2017/026; B63B 2017/0045
See application file for complete search history.

(56) References Cited

U.S. PATENT DOCUMENTS 3,438,073 A * 4/1969 Brown ..... B63B 19/02 114/361
4,070,722 A * 1/1978 Sutherland ..... A01M 31/025 135/117
4,223,414 A * 9/1980 Dickson ..... B63B 17/02 114/361
5,809,929 A * 9/1998 Garnes ..... B63B 17/02 114/364
7,032,532 B2 * 4/2006 Brooks ..... B63B 17/02 114/361
2018/0346071 A1 * 12/2018 Desautels ..... B63B 17/02

FOREIGN PATENT DOCUMENTS

WO WO-9304912 A1 * 3/1993 ..... B63B 17/02
WO WO-9406676 A1 * 3/1994 ..... B63B 17/02

* cited by examiner

*Primary Examiner* — Christopher R Harmon

(57) ABSTRACT

This hard top boat cover is designed for panels to fit the bow, middle, and stern section of different width and length size boats of similar design through using a "mix and match" system. This means that each section will have more than one panel that can be chosen from for a proper fit. The result is a hard-shell boat cover that can be created for different width and length boats solving the problem of having just one size cover that fits one size boat. The cover's overlap design allows it to fit several boats without interference from gunnel attachments or interior boat obstructions. The cover's design works with an adjustable bracket brace that holds the panel covers up over the boat while being held down by straps that connect it to the boat trailer. The bracket brace design can be placed on a range of gunnel widths and at locations on the gunnel that adjust to the width of the beam of the boat for a snug fit without scarring the gunnel.

5 Claims, 6 Drawing Sheets

MULTI-SECTIONED HARD TOP BOAT COVER

PRIORITY CLAIM AND CROSS-REFERENCE TO RELATED APPLICATIONS

This application claims priority to U.S. patent application Ser. No. 15/655,243 filed Jul. 20, 2017 that has been abandoned.

BACKGROUND OF THE INVENTION

The present invention relates to fishing boats with similar designs that must be stored outdoors and exposed to the elements. Canvas boat covers tend to collect water, snow, and debris in the bilge area of the boat on the horizontal surfaces. These boat covers, no matter how strong the fabric, tend to tear after two to three years and constantly need tightening and adjusting for tautness. Fallen limbs and tears from animal claws like squirrels, possums, and raccoons can be a problem as well. A solution is needed when no inside shelter is available to store these boats. The answer is found in the design of a hard top boat cover that is durable enough to deal with the outdoor elements while versatile enough to fit more than one boat.

Hard top boat covers have been around for a long time and are not a novel idea. However, they do come with their own limitations. They are often exceptionally large and bulky making them difficult to install by one or two people. This can lead to the need for specialized mechanical equipment to assist in this effort not making it user friendly to maintain and repair. Additionally, the large nature of these covers, if removeable, can make them difficult to store.

Another limitation for hard top boat covers is their custom design and installation. They tend to be limited to a very narrow market because they are one size and one design only fitting one boat. This is not practical to manufacturer for such a small market of consumers.

Another limitation for hard top boat covers is their custom design and installation. They often require many components and fasteners with long instructions to install. This is not practical for frequent consumer use because of the removal and re-installation process of the cover. The amount of time and special knowledge to install these covers make them impractical.

Another limitation for hard top boat covers is the "balloon" or "parachute" effect that is created in transport while attached to the boat. The cover must be secured enough to the boat to withstand great wind pressure and allow for adequate wind flow through the boat. Generally, boat covers are secured to the boat gunnel. The gunnel must be strong enough to hold the cover without undue stress or damage to prevent it from coming off. The result can be boat damage to the gunnel from frequent use. Therefore, this cover is attached to the trailer to prevent these problems.

Therefore, there remains a need in the art for a hard top boat cover that is simple, durable, easy to install with few components and versatile enough to fit several boat widths and lengths. The cover should be secure enough for transport and efficient to store.

SUMMARY OF THE INVENTION

In accordance with one embodiment the hard top boat cover comprises of a plurality of interlocking section panels to accommodate a variety of boat widths and lengths. The versatile nature of these panels allows for a "mix and match" design system to provide for a custom fit for each boat. An adjustable brace is designed to attach the hard top panels on top of the boat just outside the gunnel perimeter. This brace attaches to the gunnel on one side and travels across the beam to the gunnel on the opposite side. The hard top panels are then strapped down to the boat trailer to secure them to the boat.

Advantages of the Invention

Accordingly, there are several advantages of one or more aspects as follows:

A. Versatility in providing a hard top boat cover that fits more than one boat solves the problem of "one size fits all" approach for a hard cover. Rather than limiting the number of boats a cover will fit, the fit is determined by the panel covers to be used.

B. The overlapping nature of the boat cover provides exterior margin on each side of the boat for a more flexible fit.

C. The overlapping nature of the boat cover provides for adequate ventilation to prevent mildew while providing sufficient air flow through the cover in transport to prevent the "parachute" effect.

D. Attachment of the cover to the boat will work on most boat of similar design. The cover does not interfere with attachments on the gunnel and the boat bracket can be placed in any desired location.

E. The boat cover braces that rest on the gunnel that fit gunnel widths ranging from 1"-3½" accommodating many boat gunnel widths.

F. The boat cover brace that rests on the gunnel is rubber lined to prevent scarring.

G. The boat cover panels are high enough for single and double console boats.

H. Boat panel attachment is secure for transport because the straps attach to the boat trailer to withstand great wind pressure and held down by a strong aluminum bracket.

I. These boat cover panels can be efficiently stored through inter-stacking. This can also be an advantage in shipping the product as well.

J. The boat cover panels are strong, durable and lightweight being constructed of polyethylene or fiberglass. The nature of the boat cover material allows it be painted various colors for consumer preference as well.

These and other advantages of one or more aspects will become apparent from a consideration of the ensuing description and accompany drawings.

BRIEF DESCRIPTION OF THE DRAWINGS

The invention will now be described, by way of example, with reference to the accompanying drawings, where like numerals but different alphabetic suffixes.

DETAILED DESCRIPTION OF THE INVENTION

Referring to FIG. 1A-6B, the figures and following descriptions are intended to be illustrative or serve as an example and not limiting the application or descriptive herein. Any implementation described herein is not necessarily to be construed as advantageous or preferred over any other implementation herein. Furthermore, specific dimensions, range, or other physical characteristics relating to the described herein are not to be construed as limiting, unless expressly stated herein to the contrary.

Figure 1A:
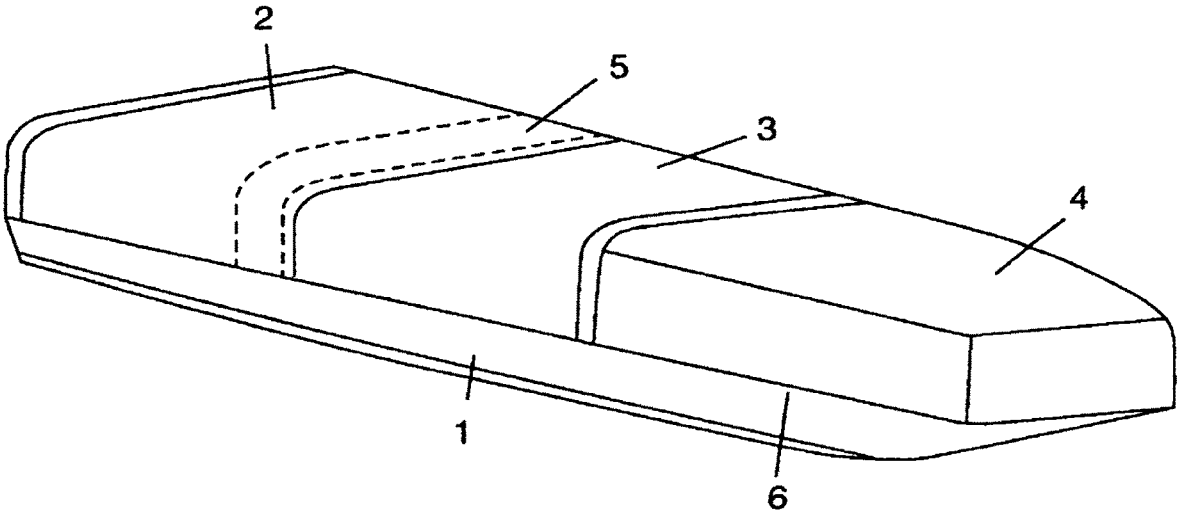
FIG. 1A shows the three-panel hard shell cover with a one-foot insert panel.

One embodiment of the boat cover is illustrated in FIG. 1A unattached to the boat trailer. It illustrates the box shaped nature of the sides of the cover coming straight upward from the gunnel 13 for two feet before turning to make the top of the cover. This is to prevent any interference of the cover from any attachments on the gunnel. Included with the three basic sectional covers 2,3,4 is a one-foot insert panel 5. The insert panel demonstrates how the overall boat cover can be lengthened for longer boats with similar widths.

Figure 1B:
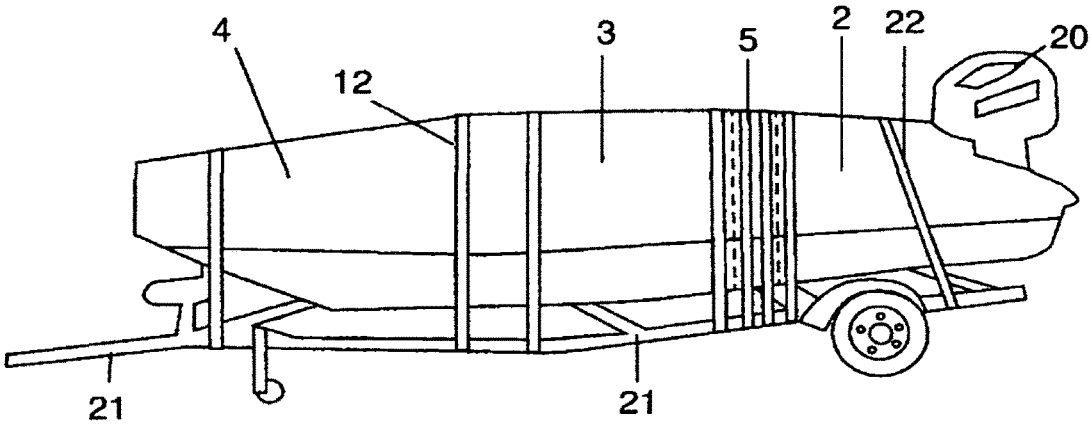
FIG. 1B shows the boat cover panels held down by straps to the boat trailer.

Another embodiment of the boat cover can be seen in FIG. 1B. This drawing illustrates how the hard top boat cover panels are strapped down to the boat trailer 21 for transport to withstand great wind pressure.

Figure 2:
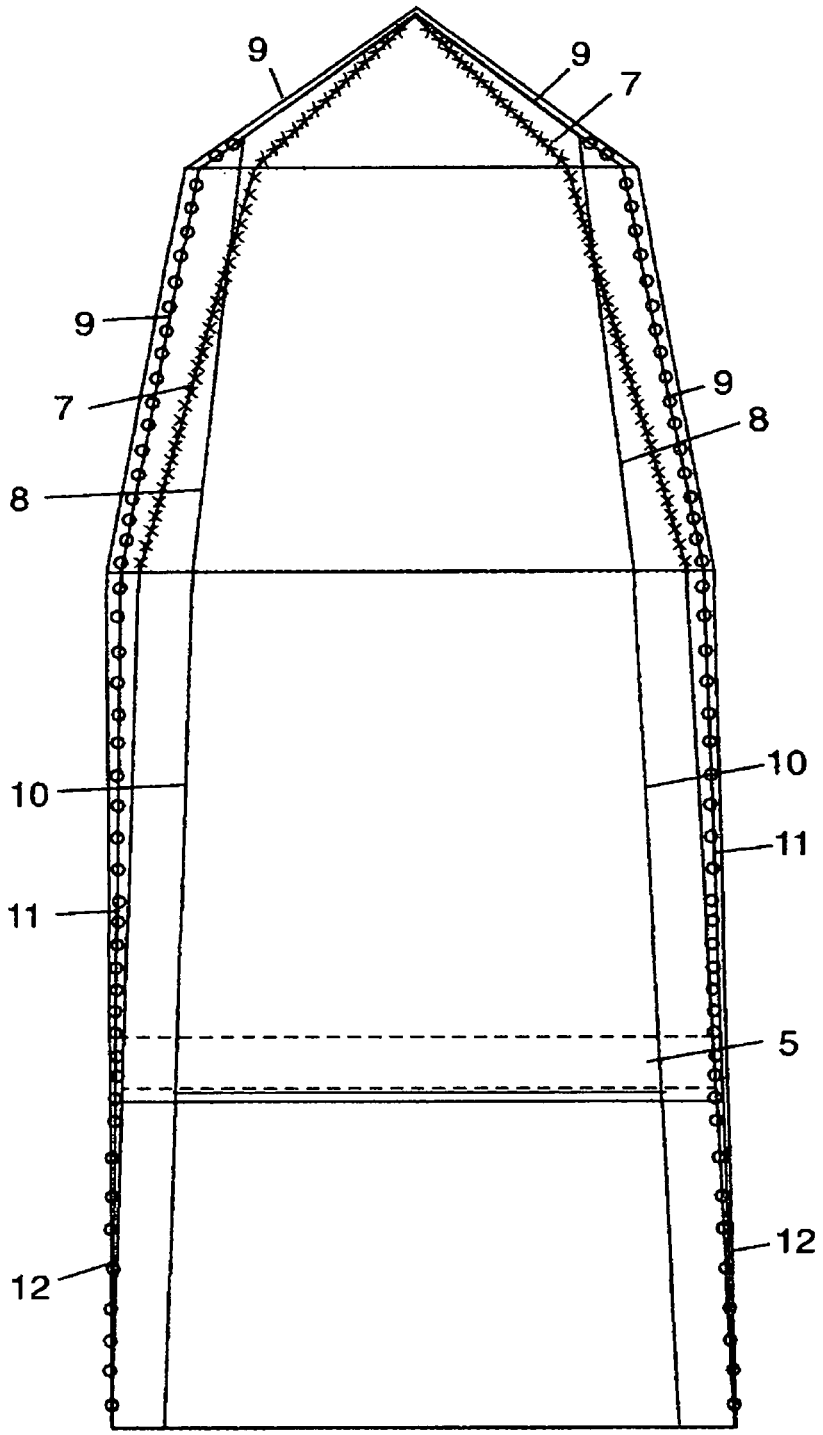
FIG. 2 shows three basic style covers that would fit three type boat widths and lengths in a "mix and match" system application.

FIG. 2. is another embodiment of the boat cover that demonstrates how the "mix and match" system works. There are three bow covers 7,8,9 and two mid covers 10, 11 and one stern cover 12. These covers will work for various widths and lengths of boats through a "mix and match" system of interchangeable panels. For example, the same bow covers 7,8,9 for a modified V-hull boat would fit most any other modified V-hull boats regardless of the different lengths. A one-foot insert panel 5 can be added to the middle or stern section as necessary to lengthen the boat cover. As for the middle section of the boat there are two sizes. One for narrow boats 10 and another for wider ones 11. As to the stern section, one cover would work for all three type boats. This is how the "mix and match" system of the hard shell boat panels would work and demonstrate the concept's flexibility.

Figure 3:
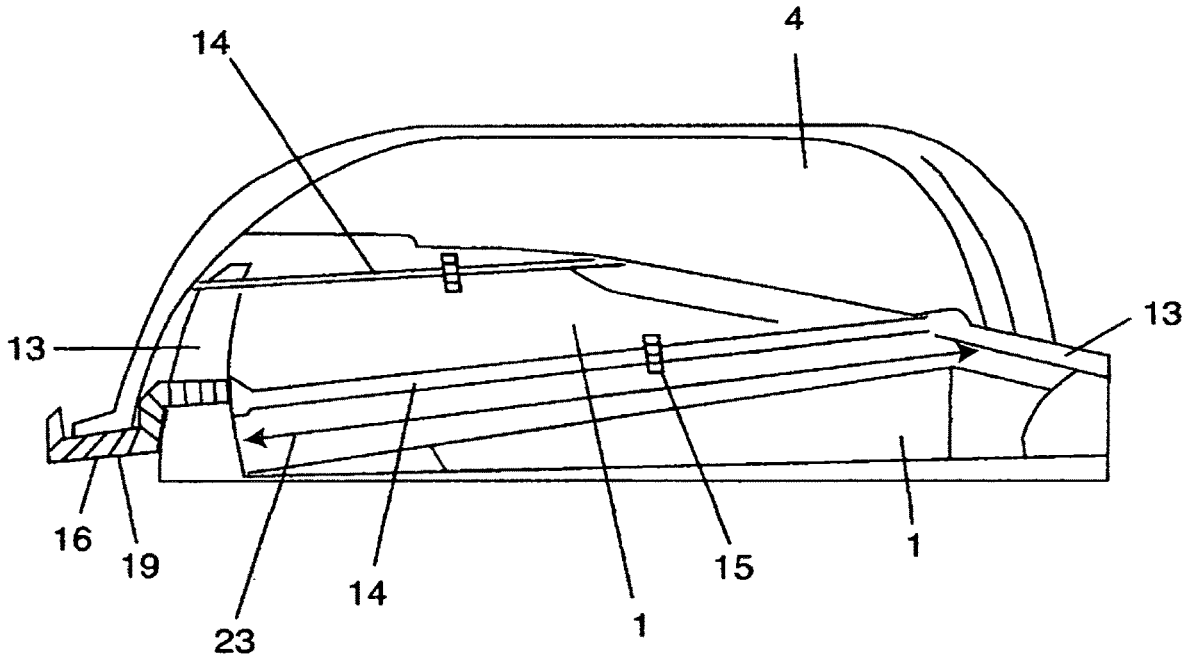
FIG. 3 shows how the boat cover would mount or be installed on the boat.

The embodiment of the boat cover in FIG. 3 demonstrates how the boat cover is installed on the boat. Due to the various boat widths and panels, an adjustable brace rod 14 with an adjustment brace knob 15 makes it a tight fit for the brace bracket to sit on the gunnel 13 to hold up the panel cover 4. The adjustable brace rod 14 and gunnel brace brackets 16 can be placed anywhere on the gunnel and across the beam where there is no interference.

Figure 4A:
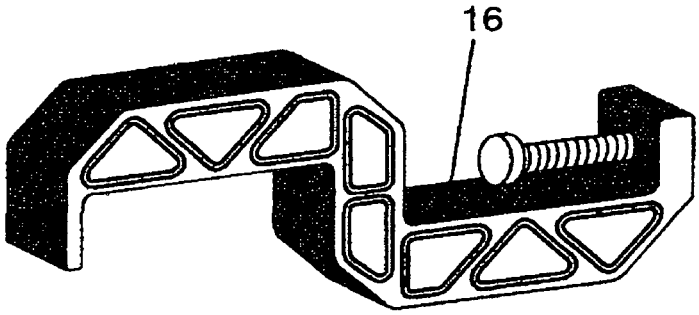
FIG. 4A shows a 3D drawing of the boat bracket brace that sits on the gunnel.
Figure 4B:
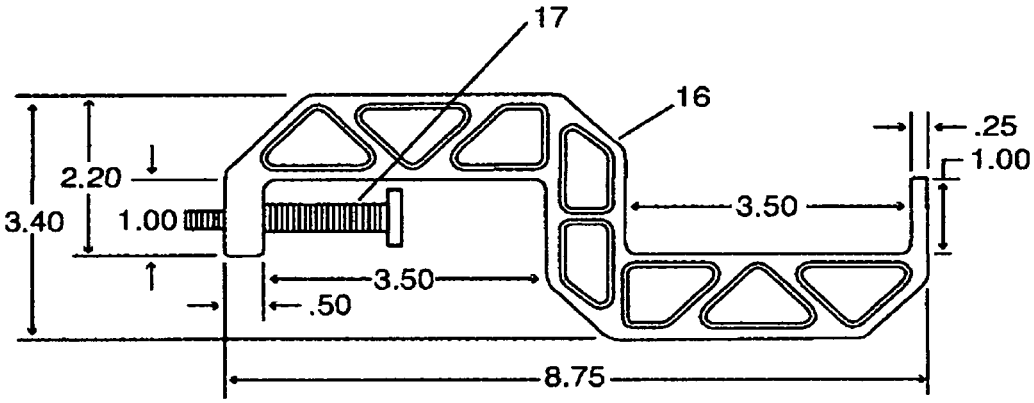
FIG. 4B shows the dimensions and construction of the boat bracket brace.
Figure 4C:
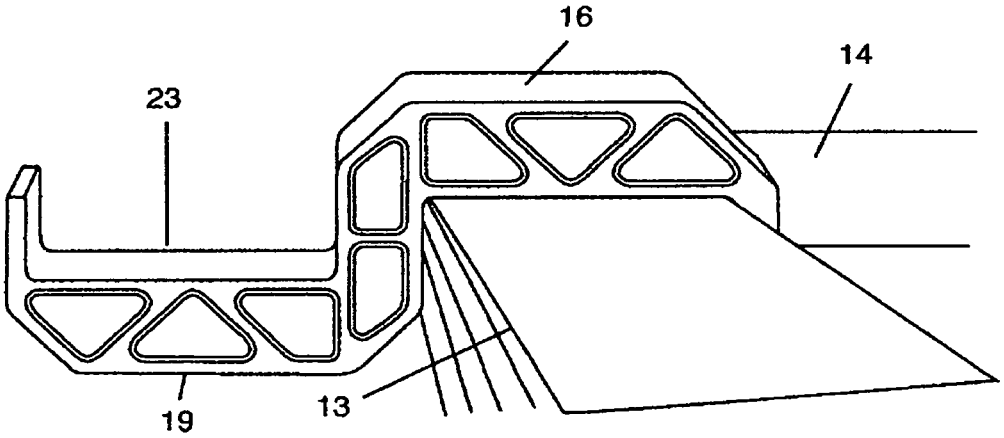
FIG. 4C shows how the boat bracket brace attaches to the gunnel.

FIG. 4A-4C demonstrates the construction, function, strength, dimensions, fit and adjustment of the boat cover brace 16. The brace itself is made of strong aluminum that is designed to hold several hundred pounds of pressure applied by the cover straps 6 that hold the cover to the trailer. The gunnel brace lip 23 allows for a three-and-a-half-inch margin on each side of the boat perimeter for a comfortable cover fit. That part of the bracket brace 16 that sits on the gunnel is adjustable for wide or narrow boat gunnels and secured in place by pressure from the adjustment brace knob 15. To prevent scarring on the gunnel, the brace bracket has rubber lining 25.

Figure 5A:
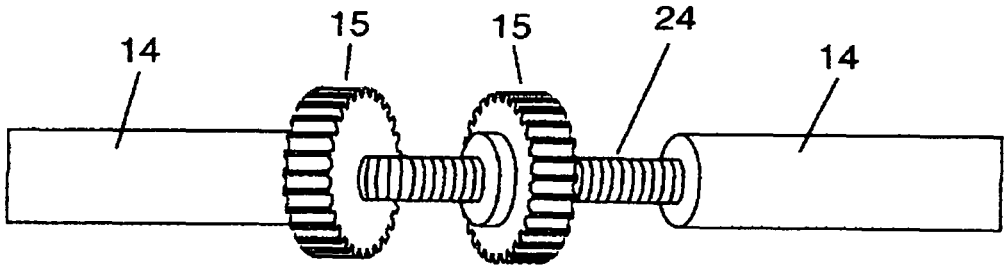
FIG. 5A shows the adjustment knob on the boat bracket rod that expands or contracts to fit the boat beam in securing the boat bracket brace to the gunnel.
Figure 5B:
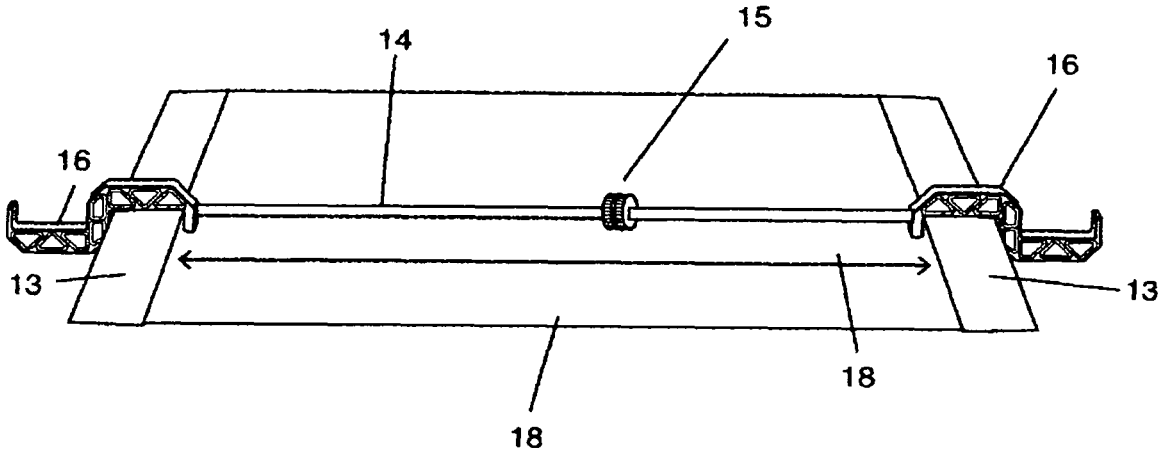
FIG. 5B shows the total boat cover bracket and rod as it attaches to both gunnels on the boat.
Figure 6A:
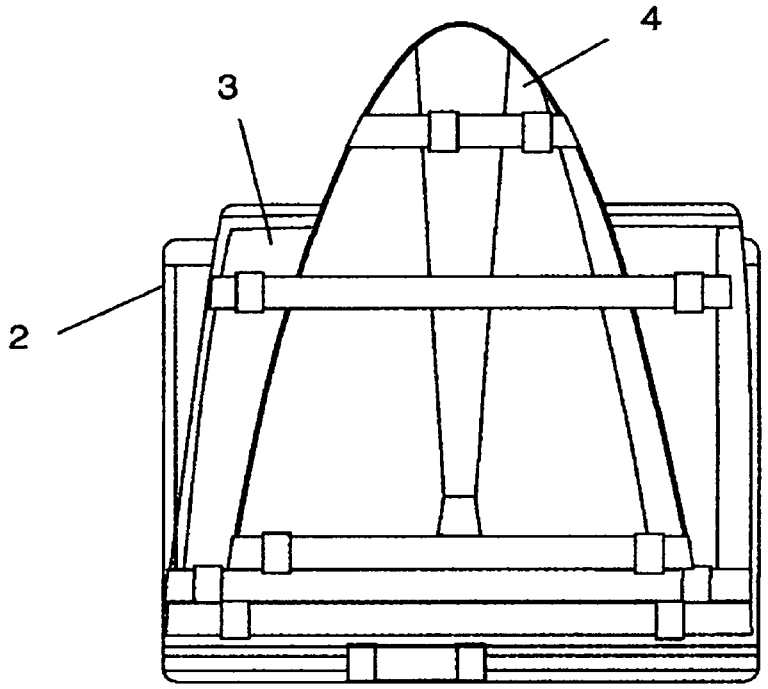
FIGS. 6A and 6B shows the efficient storage method of the three-panel boat covers through inter-stacking.
Figure 6B:
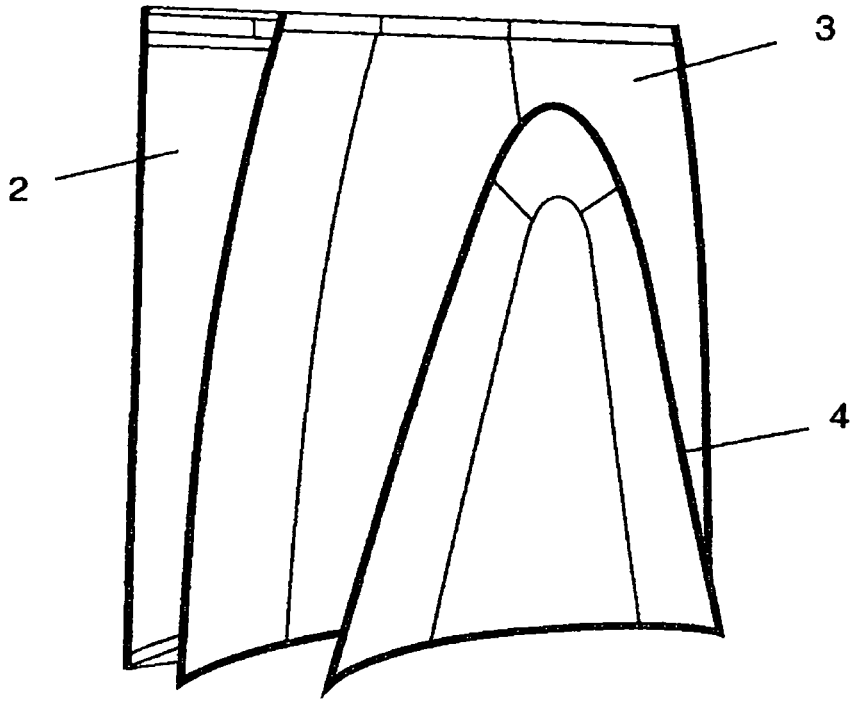

Another embodiment of the boat cover in FIG. 5A-5B demonstrates the adjustable nature of the boat brace rod 14 to the gunnel 13. When the adjustment brace knob 15 is turned clockwise it expands to make a tight fit. When the adjustment brace knob 15 is turned counterclockwise the boat brace rod gets shorter relieving the pressure. The adjustment stays in place because it works like a nut on a thread rod 24.

Another embodiment of this invention is its efficient storage and packaging for shipping. The boat panels can be stored inside one another by inter-stacking. Bow cover 4 stacks inside mid cover 3 and mid cover 3 inside stern cover 2.

REFERENCE NUMERALS

1. Boat
2. Stern cover
3. Mid cover
4. Bow cover
5. 1 ft insert cover
6. Cover straps
7. Narrow-range Bow cover
8. Mid-range Bow cover
9. Wide-range Bow cover
10. Mid-range Mid cover
11. Wide-range Mid cover
12. Wide-range Stern cover
13. Gunnel
14. Brace rod
15. Adjustment brace knob
16. Brace bracket
17. End of the adjustment rod
18. Boat beam
19. Overhang
20. Boat engine
21. Boat trailer
22. Tie-down strap
23. Gunnel brace lip
24. Threaded rod
25. Rubber lining.

I claim:

1. A boat cover system comprising a hard shell boat cover comprising of a plurality of pre-formed rigid sections that together cover the deck of a boat from bow to stern; a plurality of adjustable brace brackets which are connected to brace rods with an adjustment brace knob; and alternating pull down tension straps configured to secure each cover section in a resting position on respective brace brackets attached to opposing boat gunnels such that each cover section extends beyond the periphery of each boat gunnel.

2. The boat cover system of claim 1 wherein said sections are constructed of rigid material for stiffening the shaped section.

3. The boat cover system of claim 1 wherein said adjustable brace knobs are adjustable to fit a plurality of boat beam widths to anchor each brace bracket to a boat gunnel.

4. The boat cover system of claim 1 wherein each brace bracket has a rubber lining in order to prevent damage to said gunnel when attached.

5. The boat cover system of claim 1 further comprising 3.5 inch gunnel brace lips to allow for a total of 7 inch variance for a plurality of boat cover sectional widths to cover various boat widths.

* * * * *